US009963753B2

(12) United States Patent
Maggioli et al.

(10) Patent No.: US 9,963,753 B2
(45) Date of Patent: May 8, 2018

(54) BLAST FURNACE COOLING PLATE WITH INTEGRATED WEAR DETECTION SYSTEM

(71) Applicant: PAUL WURTH S.A., Luxembourg (LU)

(72) Inventors: Nicolas Maggioli, Thionville (FR); Nicolas Mousel, Dudelange (LU)

(73) Assignee: PAUL WURTH S.A., Luxembourg (LU)

( * ) Notice: Subject to any disclaimer, the term of this patent is extended or adjusted under 35 U.S.C. 154(b) by 0 days. days.

(21) Appl. No.: 15/502,637

(22) PCT Filed: Aug. 7, 2015

(86) PCT No.: PCT/EP2015/068301
§ 371 (c)(1),
(2) Date: Feb. 8, 2017

(87) PCT Pub. No.: WO2016/023838
PCT Pub. Date: Feb. 18, 2016

(65) Prior Publication Data

US 2017/0226601 A1 Aug. 10, 2017

(30) Foreign Application Priority Data

Aug. 11, 2014 (LU) ..... 92515

(51) Int. Cl.
*C21B 7/00* (2006.01)
*F27D 21/00* (2006.01)
(Continued)

(52) U.S. Cl.
CPC ..... *C21B 7/10* (2013.01); *F27D 9/00* (2013.01); *F27D 19/00* (2013.01);
(Continued)

(58) Field of Classification Search
CPC ..... C21B 7/10; F27D 9/00; F27D 21/0021; F27D 19/00; F27D 2021/0007;
(Continued)

(56) References Cited

U.S. PATENT DOCUMENTS 4,510,793 A * 4/1985 Ploegaert ..... G01B 17/02 73/597
4,872,345 A * 10/1989 Dicks ..... G01N 17/00 73/597

FOREIGN PATENT DOCUMENTS

FR 2356105 A1 1/1978
FR 2436187 A1 4/1980
(Continued)

OTHER PUBLICATIONS

International Search Report dated Sep. 16, 2015 re: Application No. PCT/EP2015/068301; pp. 1-3; citing: WO 2009/101246 A1, FR 2 436 187 A1 and FR 2 356 105 A1.
(Continued)

*Primary Examiner* — Scott Kastler
*Assistant Examiner* — Michael Aboagye
(74) *Attorney, Agent, or Firm* — Cantor Colburn LLP

(57) ABSTRACT

A cooling plate for a metallurgical furnace comprising a body (12) with a front face (18) and an opposite rear face (20), the body having at least one coolant channel (14) therein; the front face (18) being turned towards the furnace interior and preferably comprises alternating ribs (22) and grooves (24). The cooling plate includes wear detection means comprising: a plurality of closed pressure chambers (26, 28) distributed at different locations in said body, said pressure chambers being positioned at predetermined depths below the front face (18) of said body; and a pressure sensor (30) associated with each pressure chamber (26, 28) in order to detect a deviation from a reference pressure inside said
(Continued)

pressure chamber when the latter becomes open due to wear out of said body.

12 Claims, 2 Drawing Sheets

(51) Int. Cl.
*F27D 19/00* (2006.01)
*F27D 9/00* (2006.01)
*C21B 7/10* (2006.01)

(52) U.S. Cl.
CPC .. *F27D 21/0021* (2013.01); *F27D 2009/0005* (2013.01); *F27D 2009/0024* (2013.01); *F27D 2009/0032* (2013.01); *F27D 2021/0007* (2013.01)

(58) Field of Classification Search
CPC ..... F27D 2009/0024; F27D 2009/0032; F27D 2009/0005
USPC ..... 266/78, 99, 193, 194; 432/77
See application file for complete search history.

(56) References Cited

FOREIGN PATENT DOCUMENTS

| | | | | |
|---|---|---|---|---|
| JP | 61264110 | * | 11/1986 | ..... C21B 7/10 |
| JP | 61264110 A1 | | 11/1986 | |
| WO | 2009101246 A1 | | 8/2009 | |

OTHER PUBLICATIONS

Written opinion dated Sep. 16, 2015 re: Application No. PCT/EP2015/068301; pp. 1-5; citing: WO 2009/101246 A1, FR 2 436 187 A1 and FR 2 356 105 A1.

* cited by examiner

BLAST FURNACE COOLING PLATE WITH INTEGRATED WEAR DETECTION SYSTEM

TECHNICAL FIELD

The disclosure generally relates to cooling plates for metallurgical furnaces, namely blast furnaces, and in particular to cooling plates with means for detecting body wear after abrasion of the refractory wall.

BACKGROUND

Cooling plates for metallurgical furnaces, also called "staves", are well known in the art. They are used to cover the inner wall of the outer shell of the metallurgical furnace, as e.g. a blast furnace or electric arc furnace, to provide:

(1) a heat evacuating protection screen between the interior of the furnace and the outer furnace shell; and (2) an anchoring means for a refractory brick lining, a refractory guniting or a process generated accretion layer inside the furnace.

Originally, the cooling plates have been cast iron plates with cooling pipes cast therein. As an alternative to cast iron staves, copper staves have been developed. Nowadays, most cooling plates for a metallurgical furnace are made of copper, a copper alloy or, more recently, of steel.

The refractory brick lining, the refractory guniting material or the process generated accretion layer forms a protective layer arranged in front of the hot face of the panel-like body. This protecting layer is useful in protecting the cooling plate from deterioration caused by the harsh environment reigning inside the furnace. In practice, the furnace is however also occasionally operated without this protective layer, resulting in erosion of the lamellar ribs of the hot face.

As it is known in the art, while the blast furnace is initially provided with a refractory brick lining on the front side of the staves, this lining wears out during the campaign. In particular, it has been observed that, in the bosh section, the refractory lining may disappear relatively rapidly. While an accretion layer of slag and burdening then typically forms on the hot side of the cooling plates, it actually continuously builds-up and wears out, so that during certain periods of time the cooling plates are directly exposed to the harsh conditions inside the blast furnace, conducting to the wear of the cooling plate body.

The principal causes of wear to the accretion layer, and of course to the lining and cooling plate, are the upward flow of hot gases and the rubbing of the sinking burden (coal, ore, etc.). Regarding the flow of hot gases, the wear is not only due to a thermal load, but also to abrasion by particles carried in the ascending gases.

Document JP-A2-61264110 discloses a cooling stave comprising a wear detection system using an ultrasonic probe in contact with the rear face of the stave body to detect erosion thereof. This appears as a cumbersome technique to be implemented in the blast furnace environment.

BRIEF SUMMARY

The disclosure provides an alternative and reliable way of monitoring the wear status of cooling plates.

A cooling plate for a metallurgical furnace is provided comprising a body with a front face and an opposite rear face, the body having at least one coolant channel therein. In use, the front face, which preferably comprises alternating ribs and grooves, is turned towards the furnace interior.

It shall be appreciated that the cooling plate is provided with wear detection means, which comprise a plurality of closed pressure chambers distributed at different locations within the body and positioned at predetermined depths below the front face of the body. A pressure sensor is associated with each pressure chamber in order to detect a deviation from a reference pressure when a pressure chamber becomes open due to wear out of the body portion.

The disclosure thus proposes a way of detecting the wear of cooling plates relying on the physical principle of pressure variation, which is easy and relatively inexpensive to monitor. Furthermore, the network of closed pressure chambers embedded in the plate body allows the concomitant monitoring of the wear at several locations and to possibly distinguish several wear statuses (or wear levels), depending on the number of closed pressure chambers and their distance to the surface. Hence, the disclosure allows an enhanced monitoring of a cooling plate where one can know the wear status of the cooling plate at several body regions, and even can distinguish between different wear conditions in a same region.

In a preferred embodiment, the pressure chambers are formed as blind bores drilled from the rear face of the body, and closed by a sealingly mounted plug. Each pressure sensor may then be supported by its respective plug, and the connecting wire of the pressure sensor sealingly passes through the plug towards the exterior. Suitable sensors are e.g. of the piezoelectric type. For ease of implementation, the pressure chambers, respectively the blind bores, may be formed as elongate hollow chambers extending substantially perpendicularly to the front face of the body. The blind bores can, e.g., have a diameter of less than 5 mm, preferably in-between 1 and 3 mm.

Advantageously, the pressure chambers are distributed at the different locations by groups of at least two pressure chambers, each pressure chamber within the group being positioned at a different predetermined depth below the front face of said body. In particular, within each group, a pressure chamber may be positioned underneath a rib and a pressure chamber positioned underneath a groove. In doing so, one can monitor several regions of a cooling plate and within each region even distinguish between different wear levels. For example, the groups of pressure chambers may be located in the upper, bottom and central sections of the body, preferably using 2 or 3 groups per section.

In practice, the pressure chambers are manufactured as closed and sealed chambers containing a given fluid at a reference pressure, selected so that in use the reference pressure therein is different from the blast furnace operating pressures. For ease of implementation, the fluid inside the pressure chambers is air, although other gases (especially inert gases) could in principle be used. In principle the fluid in the pressure chambers may be a liquid, e.g. water, but again gases and in particular air are preferred, to avoid releasing water inside the furnace even in small amounts. The reference pressure for gas may be selected from: vacuum pressure, a pressure lower than the furnace operating pressure, a pressure higher than the furnace operating pressure. Supposing a typical blast furnace operating pressure in the range of 2 to 3 bars, the reference pressure (measured at ambient temperature) may for example be around 1 bar (atmospheric pressure), or about 4-5 bars, or higher.

According to another aspect, the invention concerns a blast furnace comprising a shell lined with cooling plates as described above, and comprising a control system which is configured to: receive pressure signals from each of the pressure sensors of the pressure chambers in the cooling plates; to detect pressure deviation from the reference pressure at the pressure sensors; and to display a mapping of the wear status of the cooling plate lining based on the information from the pressure signals and the known location of the cooling plates in the blast furnace.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
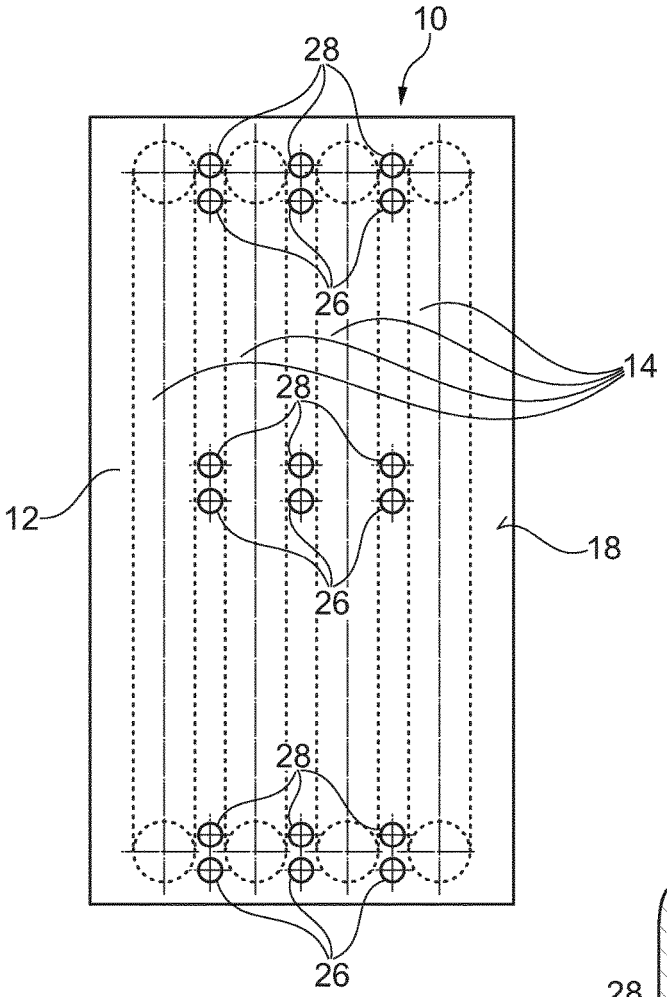
FIG. 1: is a principle drawing of an embodiment of the present cooling plate.
Figure 3:
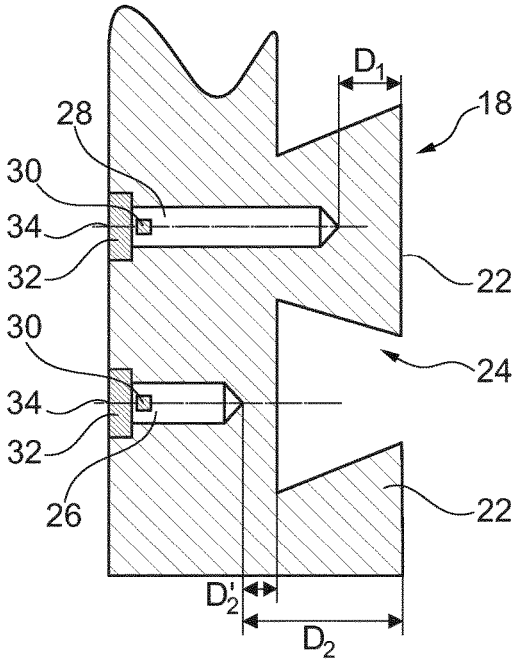
FIG. 3: is an enlarged view of detail A of FIG. 2.
Figure 2:
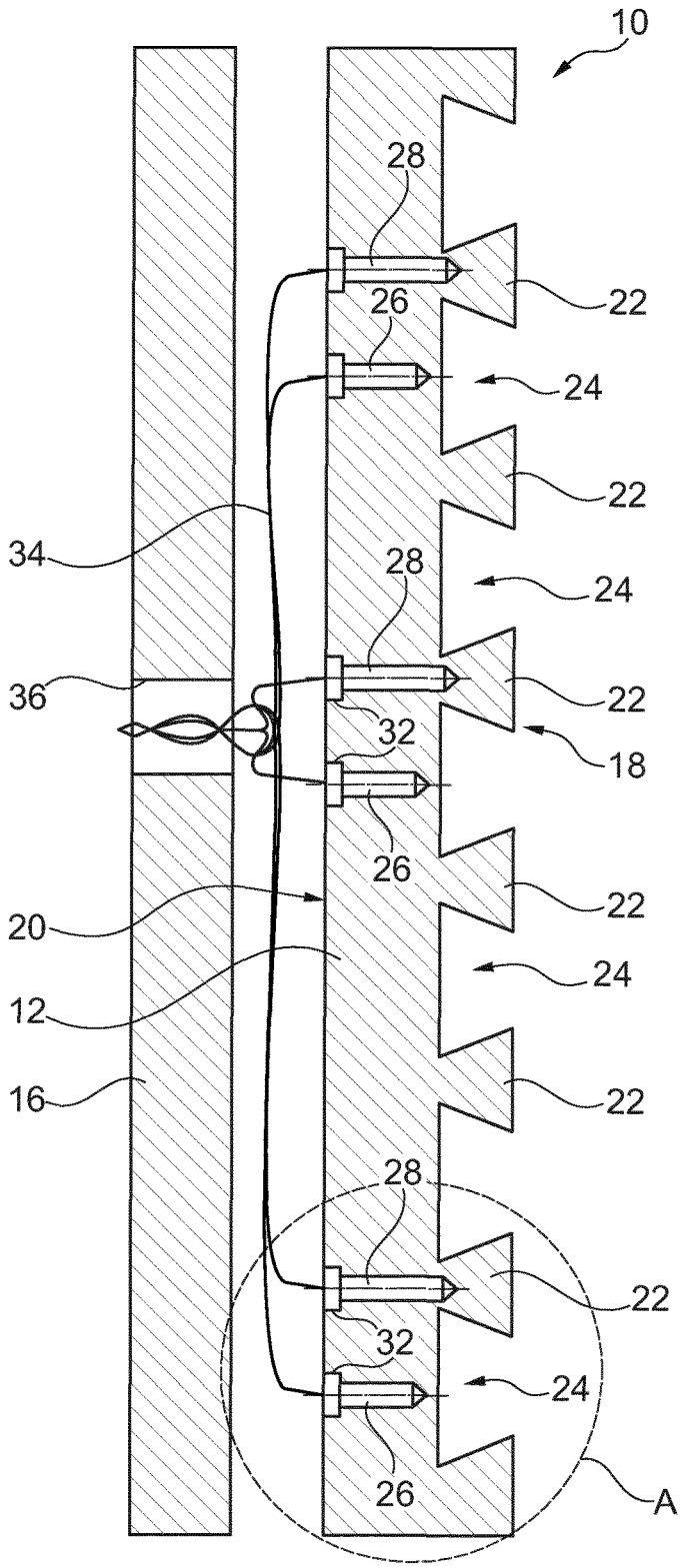
FIG. 2: is a vertical section view through the cooling plate of FIG. 1, mounted on a furnace outer shell.

A preferred embodiment of the present cooling plate 10 is schematically illustrated in FIGS. 1-3. The cooling plate 10 comprises a body 12 that is typically formed from a slab e.g. made of a cast or forged body of copper, copper alloy or steel. Furthermore, the body 12 has at least one conventional coolant channel 14 embedded therein. As it can be seen from FIG. 1, the cooling plate 10 is represented here with four coolant channels 14 in order to provide a heat evacuating protection screen between the interior of the furnace and the outer furnace shell 16 (or armor).

FIG. 2 shows the cooling plate 10 of FIG. 1 in cross-section, mounted onto the furnace shell 16. The body 12 has a front face generally indicated 18, also referred to as hot face, which is turned towards the furnace interior, and an opposite rear face 20, also referred to as cold face, which in use faces the inner surface of the furnace shell 16.

As is known in the art, the front face 18 of body 12 advantageously has a structured surface, in particular with alternating ribs 22 and grooves 24. When the cooling plate 10 is mounted in the furnace, the grooves 24 and lamellar ribs 22 are generally arranged horizontally in order to provide an anchoring means for a refractory brick lining (not shown).

As it is known, during the course of operation of a blast furnace or similar, the refractory brick lining erodes due to the descending burden material, leading to the fact that the cooling plates are unprotected and have to face the harsh environment inside the blast furnace.

As a result, abrasion of the cooling plates occurs too and it is desirable to know the wear status of the cooling plates.

It shall be appreciate that the present cooling plate 10 is equipped with wear detection means, as will now be explained.

The present wear detection means comprise a plurality of closed pressure chambers 26, 28 distributed at different locations in the body 12 and positioned at predetermined depths below the front face 18 of the body 12. The closed pressure chambers 26, 28 are manufactured to be set at an internal reference pressure (normally different from the blast furnace operating pressure), and a pressure sensor 30 is associated with each pressure chamber 26, 28. When the body 12 will have eroded down to the depth of a closed pressure chamber, the latter will become open and the pressure will equilibrate with the operating pressure of the blast furnace. In monitoring the pressure in the closed pressure chamber 26, 28 one can thus detect the moment the closed pressure chamber opens, which will be indicated by a deviation from the initial reference pressure. In practice, the closed pressure chambers 26, 28 may be formed as blind bores, drilled from the rear face 20 of the cooling plate. These holes are drilled substantially perpendicularly to the front face 18 of the cooling plate 10 as it can be seen from FIGS. 2 and 3. The blind bores may be of small diameter, preferably in the range of 1 to 3 mm. Each blind bore is closed by a plug 32 in order to seal the pressure chamber 26, 28. The plug further supports the pressure sensor 30 such that the pressure sensor faces the inside of the closed pressure chamber. Such pressure sensor 30 may be of the piezoelectric type. The connecting wires 34 of each pressure sensor 30 sealingly pass through the plug 32 and are guided towards the furnace exterior through an opening 36 in the furnace shell, as represented in FIG. 2.

As indicated above, the monitoring principle is based on a pressure deviation from a reference pressure. Accordingly, each pressure chamber 26, 28 is initially set to a reference gas pressure, which is different from the usual blast furnace operating pressures. In that way a significant change in pressure can be measured when a closed pressure chamber becomes open due to wear out of the body portion initially separating the inner end of the pressure chamber from the front edge of the panel. The pressure in the each pressure chamber 26, 28 may thus be set to a reference pressure that is either lower, or higher than the blast furnace operating pressures, or may even be set to a vacuum pressure.

In FIG. 1, the position of the pressure chambers 26, 28 is schematically indicated by the solid line circles. As it can be seen, they are distributed at different well-defined locations in the cooling plate body. As already apparent from the other drawings, the closed pressure chambers are preferably arranged by groups.

For example, the pressure chambers may be distributed by groups of at least two pressure chambers, each pressure chamber within the group being positioned at a different predetermined depth below the front face of said body. Turning to FIG. 3, one can see that one pressure chamber is assigned to a rib 22 whereas the other pressure chamber is assigned to a groove.

The inner extremity of pressure chamber 28 is located at distance $D_1$ below the surface of the rib, whereas chamber 26 is located at distance $D_2$ below the respective groove, which may also be referred to as distance $D'_2$ when comparing to the neighboring rib 22.

The so-called "depth" of a pressure chamber thus corresponds to the distance from the inner end of the pressure chamber in the body to the front face 18 of the cooling plate here $D_1$ and $D'_2$ when taking as reference the front side at the level of non-used ribs 22 in a new cooling plate.

the detection of a pressure variation in pressure chambers 28 will thus imply that the rib thickness has decreased by more than $D_1$. The detection of a pressure variation in pressure chamber 26 will imply that the thickness of body at groove 24 has diminished by more than $D'_2$, or that the wear level at the groove 22 is more than $D_2$ (depending on the reference).

The configuration shown in the Figures thus allows monitoring 9 different location/regions of the cooling plate 10: the cooling plate is divided into upper, bottom and central sections, each of them being subdivided into left, right and center portions.

Furthermore, for each region, one can monitor the wear of a rib and of a groove.

The invention claimed is:

1. A cooling plate for a metallurgical furnace comprising:

a body with a front face and an opposite rear face, said body having at least one coolant channel therein;

wherein in use said front face is turned towards a furnace interior comprises alternating ribs and grooves; and wear detection means adapted to monitor the wear of said body;

wherein said wear detection means comprise:

a plurality of closed pressure chambers distributed at different locations in said body, said pressure chambers being positioned at predetermined depths below said front face of said body; and a pressure sensor associated with each pressure chamber is configured to measure a fluid pressure inside each pressure chamber in order to detect a deviation of pressure from a reference pressure inside said pressure chamber when said pressure chamber becomes open due to wear out of said body, wherein the reference pressure is different from a furnace operating pressure.

2. The cooling plate according to claim 1, wherein said pressure chambers are formed as blind bores drilled from said rear face of said body, and closed by a sealingly mounted plug.

3. The cooling plate according to claim 2, wherein said pressure chambers, respectively said blind bores, are elongate hollow chambers extending substantially perpendicularly to said front face of said body.

4. The cooling plate according to claim 2, wherein said pressure sensor is supported by said plug, and connecting wires of said pressure sensor sealingly pass through said plug towards the exterior.

5. The cooling plate according to claim 3, wherein said pressure chambers, respectively said blind bores, have a diameter of less than 5 mm.

6. The cooling plate according to claim 1, wherein said pressure chambers are distributed at said different locations by groups of at least two pressure chambers, each pressure chamber within the group being positioned at a different predetermined depth below the front face of said body.

7. The cooling plate according to claim 6, wherein within each group, a pressure chamber is positioned underneath a rib and a pressure chamber is positioned underneath a groove.

8. The cooling plate according to claim 7, wherein said groups of pressure chambers are located in the upper, bottom and central regions of the body.

9. The cooling plate according to claim 1, wherein said pressure sensor is of the piezoelectric type.

10. The cooling plate according to claim 1, wherein each pressure chamber is at a reference pressure selected from: vacuum pressure, a gas pressure lower than the furnace operating pressure, a gas pressure higher than the furnace operating pressure.

11. A blast furnace comprising a shell lined with cooling plates according to claim 1, comprising a control system configured to:

receive pressure signals from each of the pressure sensors of said pressure chambers in said cooling plates;

detect pressure deviations from the reference pressure at one or more of said pressure sensors;

display a mapping of the wear status of said cooling plate lining based on the information from said pressure signals and the known location of the cooling plates in said blast furnace.

12. The cooling plate according to claim 1, wherein each pressure chamber is a hole from the rear face of the cooling plate and extending substantially perpendicular to the front face of the cooling plate.

* * * * *